US009196188B2

(12) United States Patent
Kimura

(10) Patent No.: US 9,196,188 B2
(45) Date of Patent: Nov. 24, 2015

(54) IMAGE DISPLAY APPARATUS AND CONTROL METHOD THEREFOR

(75) Inventor: Takushi Kimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 440 days.

(21) Appl. No.: 13/295,812

(22) Filed: Nov. 14, 2011

(65) Prior Publication Data

US 2012/0127216 A1 May 24, 2012

(30) Foreign Application Priority Data

Nov. 22, 2010 (JP) ..... 2010-260079
Aug. 5, 2011 (JP) ..... 2011-171638

(51) Int. Cl.
*G09G 3/36* (2006.01)
*G09G 3/34* (2006.01)
(Continued)

(52) U.S. Cl.
CPC ..... *G09G 3/2022* (2013.01); *G09G 3/18* (2013.01); *G09G 3/2025* (2013.01); *G09G 3/22* (2013.01); *G09G 3/3406* (2013.01); *G09G 3/3433* (2013.01); *G09G 3/36* (2013.01); *G09G 3/3648* (2013.01); *G09G 3/3651* (2013.01); *G09G 2300/0486* (2013.01); *G09G 2310/0237* (2013.01); *G09G 2320/0271* (2013.01); *G09G 2320/062* (2013.01);
(Continued)

(58) Field of Classification Search
CPC ..... G09G 3/3648; G09G 3/3406; G09G 2320/0646; G09G 2320/16; G09G 2320/0626; G09G 2320/0653; G09G 2320/062; G09G 2340/0435; G09G 3/2022; G09G 2310/0237; G09G 2300/0486; G09G 3/2025; G09G 2320/0271; G09G 3/36; G09G 3/3433; G09G 3/22; G09G 3/3651; G09G 3/18
USPC ..... 345/87, 102; 382/260; 348/542, 102
See application file for complete search history.

(56) References Cited

U.S. PATENT DOCUMENTS 5,844,534 A * 12/1998 Okumura et al. ..... 345/90
8,571,217 B2 * 10/2013 Ishii et al. ..... 380/218
(Continued)

FOREIGN PATENT DOCUMENTS

JP 2006-184896 7/2006

OTHER PUBLICATIONS

Kershaw, Simon, Sigma-Delta Bitstream Processors Analysis and Design, Ph.D. Thesis submitted to Kings College London, recorded in Maughan Library about 1997, pp. 33, 42, 53, and 212.*
(Continued)

*Primary Examiner* — Michael J Eurice
(74) *Attorney, Agent, or Firm* — Cowan, Liebowitz & Latman, P.C.

(57) ABSTRACT

An image processing unit includes a filter unit which performs high frequency emphasis processing on a image signal of a first sub-frame among a plurality of sub-frames, and performs high frequency suppression processing on a image signal of a second sub-frame different from the first sub-frame; and a level adjustment unit which performs level adjustment processing on the image signal of the first sub-frame, and performs level adjustment processing different from the level adjustment processing on the image signal of the second sub-frame. Alight source control unit controls light quantity of a light source during a period of a sub-frame in which the image signal subjected to the level adjustment processing is outputted, in accordance with the level adjustment performed on the sub-frame.

23 Claims, 12 Drawing Sheets

(51) Int. Cl.
*G09G 3/18* (2006.01)
*G09G 3/20* (2006.01)
*G09G 3/22* (2006.01)

(52) U.S. Cl.
CPC ..... *G09G 2320/0646* (2013.01); *G09G 2340/0435* (2013.01); *G09G 2360/16* (2013.01)

(56) References Cited

U.S. PATENT DOCUMENTS

| | | | | |
|---|---|---|---|---|
| 8,643,707 | B2 * | 2/2014 | Matsumoto et al. | 348/56 |
| 2002/0057253 | A1 * | 5/2002 | Lim et al. | 345/102 |
| 2006/0119617 | A1 * | 6/2006 | Toyooka et al. | 345/619 |
| 2006/0146007 | A1 * | 7/2006 | Lim et al. | 345/102 |
| 2007/0024772 | A1 * | 2/2007 | Childers et al. | 349/68 |
| 2007/0262937 | A1 | 11/2007 | Take et al. | |
| 2007/0263121 | A1 * | 11/2007 | Take et al. | 348/448 |
| 2008/0106657 | A1 * | 5/2008 | Kitayama et al. | 349/37 |
| 2008/0180385 | A1 * | 7/2008 | Yoshida et al. | 345/102 |
| 2008/0284719 | A1 * | 11/2008 | Yoshida | 345/102 |
| 2008/0284768 | A1 * | 11/2008 | Yoshida et al. | 345/208 |
| 2008/0284929 | A1 * | 11/2008 | Kimura | 349/38 |
| 2008/0284931 | A1 * | 11/2008 | Kimura | 349/39 |
| 2008/0297676 | A1 * | 12/2008 | Kimura | 349/39 |
| 2009/0002585 | A1 * | 1/2009 | Shimoshikiryoh et al. | 349/39 |
| 2009/0002586 | A1 * | 1/2009 | Kimura | 349/39 |
| 2009/0040376 | A1 * | 2/2009 | Kobayashi | 348/452 |
| 2009/0273611 | A1 * | 11/2009 | Itokawa et al. | 345/619 |
| 2010/0026678 | A1 * | 2/2010 | Sakashita | 345/213 |
| 2010/0098349 | A1 * | 4/2010 | Arashima et al. | 382/263 |
| 2010/0253853 | A1 * | 10/2010 | Sakashita | 348/687 |
| 2011/0134229 | A1 * | 6/2011 | Matsumoto et al. | 348/56 |
| 2011/0243325 | A1 * | 10/2011 | Ishii et al. | 380/218 |

OTHER PUBLICATIONS

Norsworthy, Steven R., et al., Delta-Sigma Data Converters, IEEE Press 1997, pp. 2-4, 6, and 293.*

The above references ware cited in a Feb. 29, 2012 Great Britain Search Report a copy of which is enclosed of the counterpart Great Britain Patent Application No. 1120029.2.

* cited by examiner

FIG. 5

| | HIGH FREQUENCY EMPHASIS COEFFICIENT | LEVEL COMPRESSION COEFFICIENT | BACKLIGHT COEFFICIENT |
|---|---|---|---|
| FIRST SUB-FRAME | 1 | 1／2 | 2 |
| SECOND SUB-FRAME | −1 | 1 | 1 |

*FIG. 9*

| | HIGH FREQUENCY EMPHASIS COEFFICIENT | LEVEL COMPRESSION/ EXPANSION COEFFICIENT | BACKLIGHT COEFFICIENT |
|---|---|---|---|
| FIRST SUB-FRAME | 1 | 1／2 | 2 |
| SECOND SUB-FRAME | −1 | G | 1／G |

IMAGE DISPLAY APPARATUS AND CONTROL METHOD THEREFOR

BACKGROUND OF THE INVENTION

1. Field of the Invention

The present invention relates to a technology for displaying an input image signal at a frame rate higher than an original frame rate.

2. Description of the Related Art

Conventionally, there has been a method in which a frame rate of an inputted image signal is doubled, and a motion blur and a flicker are reduced by alternately outputting a sub-frame in which a spatial high-frequency component is emphasized and a sub-frame in which the spatial high-frequency component is suppressed (for example, Japanese Patent Application Laid-open No. 2006-184896).

However, the conventional art described above has had a problem that that the effect of improving video resolution is reduced when an image signal level exceeds the maximum gradation by the emphasis of the spatial high-frequency component. For example, an 8-bit image signal takes 256 step levels of 0 to 255 (gradation values). When the spatial high-frequency component is emphasized in such image signal, in a pixel which originally has high gradation, the image signal level after the emphasis may exceed 255 as the maximum gradation. Since the image signal exceeding the maximum gradation can not be displayed on a display panel, a portion exceeding 255 has been cut off by using a clip circuit or a limiter circuit and the maximum level of the image signal has been limited to 255 or less. However, by this operation, apart of the high-frequency component of the image signal is lost, and particularly in a high gradation range, the effect of improving video resolution is reduced.

SUMMARY OF THE INVENTION

An object of the present invention is to provide an image display apparatus which prevents a reduction in the effect of improving video resolution even when the image signal level exceeds the maximum gradation level by the emphasis of the spatial high-frequency component, and a control method therefor.

The present invention in its first aspect provides an image display apparatus including: a liquid crystal unit which has a light source and a liquid crystal device for controlling a transmittance of light from the light source based on an image signal; an image processing unit which divides each frame of an input image signal into a plurality of sub-frames, and outputs the image signals of the plurality of sub-frames to the liquid crystal unit at a frame rate higher than that of the input image signal; and a light source control unit which controls a light quantity of the light source, wherein the image processing unit includes: a filter unit which performs high frequency emphasis processing for emphasizing a spatial high-frequency component on the image signal of a first sub-frame among the plurality of sub-frames, and performs high frequency suppression processing for suppressing a spatial high-frequency component on the image signal of a second sub-frame different from the first sub-frame; and a level adjustment unit which performs level adjustment processing on the image signal of the first sub-frame, and performs level adjustment processing different from the level adjustment processing on the image signal of the second sub-frame, and the light source control unit controls the light quantity of the light source during a period of a sub-frame in which the image signal subjected to the level adjustment processing is outputted, in accordance with the level adjustment performed on the sub-frame.

The present invention in its second aspect provides a control method for an image display apparatus which includes a liquid crystal unit having a light source and a liquid crystal device for controlling a transmittance of light from the light source based on an image signal, including the steps of: dividing each frame of an input image signal into a plurality of sub-frames; performing high frequency emphasis processing for emphasizing a spatial high-frequency component on the image signal of a first sub-frame among the plurality of sub-frames, and performing high frequency suppression processing for suppressing a spatial high-frequency component on the image signal of a second sub-frame different from the first sub-frame; performing level adjustment processing on the image signal of the first sub-frame, and performing level adjustment processing different from the level adjustment processing on the image signal of the second sub-frame; and outputting the image signals of the plurality of sub-frames to the liquid crystal unit at a frame rate higher than that of the input image signal, wherein a light quantity of the light source during a period of a sub-frame in which the image signal subjected to the level adjustment processing is outputted is controlled in accordance with the level adjustment performed on the sub-frame.

The present invention in its third aspect provides an image display apparatus including: a self-emitting display panel unit which causes an electron to be emitted from cold cathode elements arranged in a matrix based on an image signal, accelerates the emitted electron using an acceleration voltage, causes the emitted electron to collide with a fluorescent material to emit light; an image processing unit which divides each frame of an input image signal into a plurality of sub-frames, and outputs the image signals of the plurality of sub-frames to the display panel unit at a frame rate higher than that of the input image signal; and an acceleration voltage control unit which controls the acceleration voltage, wherein the image processing unit includes: a filter unit which performs high frequency emphasis processing for emphasizing a spatial high-frequency component on the image signal of a first sub-frame among the plurality of sub-frames, and performs high frequency suppression processing for suppressing a spatial high-frequency component on the image signal of a second sub-frame different from the first sub-frame; and a level adjustment unit which performs level adjustment processing on the image signal of the first sub-frame, and performs level adjustment processing different from the level adjustment processing on the image signal of the second sub-frame, and the acceleration voltage control unit controls the acceleration voltage during a period of a sub-frame in which the image signal subjected to the level adjustment processing is outputted, in accordance with the level adjustment performed on the sub-frame.

According to the present invention, it is possible to implement image display having improved video resolution even when the image signal level exceeds the maximum gradation level by the emphasis of the spatial high-frequency component.

Further features of the present invention will become apparent from the following description of exemplary embodiments with reference to the attached drawings.

BRIEF DESCRIPTION OF THE DRAWINGS

FIG. 5 shows an example of each coefficient outputted from a control unit according to the second embodiment;

FIG. 9 shows an example of each coefficient outputted from a control unit according to the third embodiment;

DESCRIPTION OF THE EMBODIMENTS

One aspect of the present invention relates to an image display apparatus which includes at least a liquid crystal panel unit having a light source and a liquid crystal device for controlling a transmittance of light from the light source, an image processing unit for performing image processing such as frame rate conversion and the like on an input image signal, and a light source control unit for controlling a light quantity of the light source. Examples of the image display apparatus according to the present invention include a liquid crystal display (LCD), a liquid crystal projector, and the like. As the light source (also referred to as a backlight), any light source such as a cold cathode tube, a white light emitting diode (LED), a color LED of RGB or the like, and an electroluminescent panel can be used. Among them, the LED light source is preferred for the present invention due to its advantages of easy and precise controllability of the light quantity, a wide color reproduction range, and small power consumption.

First Embodiment

A description is given hereinbelow of an image display apparatus and a control method therefor according to a first embodiment of the present invention with reference to the drawings.

Figure 1:
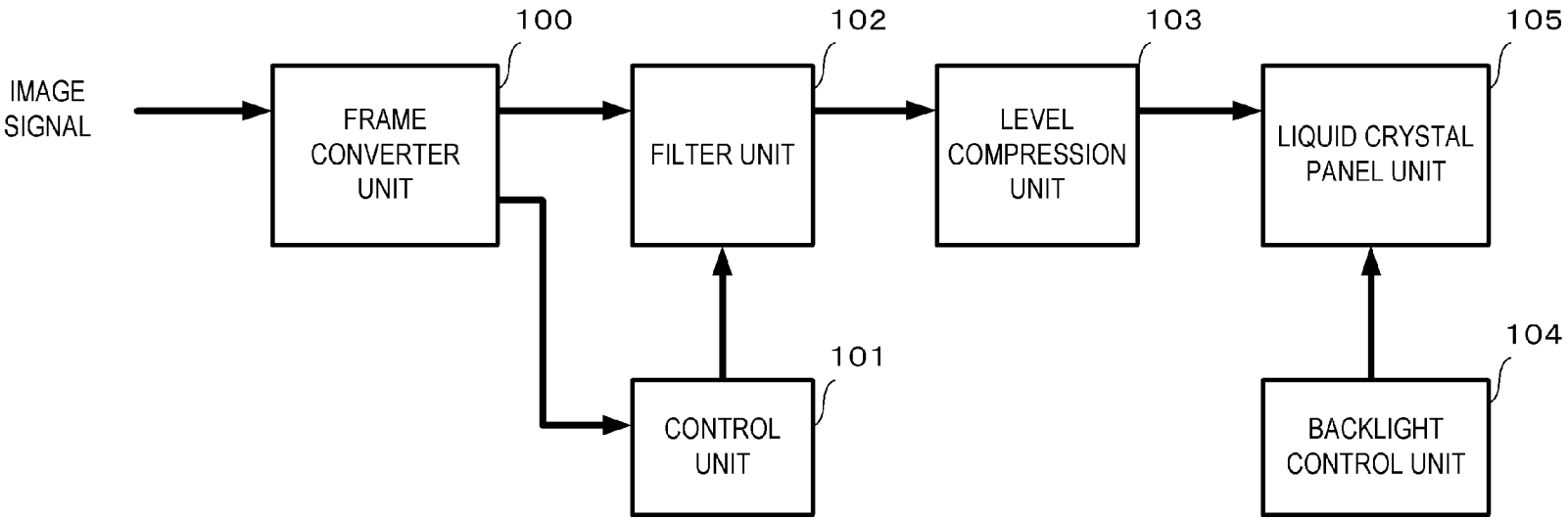
FIG. 1 is a view showing an example of a functional configuration of an image display apparatus according to a first embodiment.

FIG. 1 is a view showing an example of the functional configuration of the image display apparatus according to the first embodiment.

The image display apparatus includes a frame converter unit 100, a control unit 101, a filter unit 102, a level compression unit 103, a backlight control unit 104, and a liquid crystal panel unit 105.

The frame converter unit 100 doubles a frame rate of an image signal inputted from the outside to thereby divide one frame into two sub-frames of a first sub-frame and a second sub-frame. Subsequently, the frame converter unit 100 repeatedly outputs the inputted image signal during the period of each of the sub-frames. The image signal of each of the sub-frames is inputted to the filter unit 102. In addition, the frame converter unit 100 outputs a sub-frame identification signal for identifying the period of the first sub-frame or the second sub-frame during the period of each of the sub-frames. The sub-frame identification signal is inputted to the control unit 101.

The control unit 101 outputs a high frequency emphasis coefficient based on the sub-frame identification signal supplied from the frame converter unit 100. The control unit 101 outputs 1 as the high frequency emphasis coefficient during the period of the first sub-frame, and outputs −1 as the high frequency emphasis coefficient during the period of the second sub-frame. The high frequency emphasis coefficient is inputted to the filter unit 102. Herein, the high frequency emphasis coefficient is a parameter for switching the content of filter processing performed on the image signal in the filter unit 102. The positive coefficient indicates processing for emphasizing a spatial high-frequency component, while the negative coefficient indicates processing for suppressing (reducing) the spatial high-frequency component. Although the high frequency emphasis coefficient takes only the value of 1 or −1 in the present embodiment, any value can also be used. As the absolute value of the high frequency emphasis coefficient is larger, the degree of emphasis or suppression of the high-frequency component is larger.

The filter unit 102 emphasizes or suppresses the spatial high-frequency component of the image signal of the sub-frame outputted from the frame converter unit 100 based on the high frequency emphasis coefficient given from the control unit 101, and outputs the resultant image signal. Hereinbelow, the processing for emphasizing the spatial high-frequency component is referred to as high frequency emphasis (HF emphasis) processing, and the processing for suppressing the spatial high-frequency component is referred to as high frequency suppression (HF suppression) processing.

Figure 2:
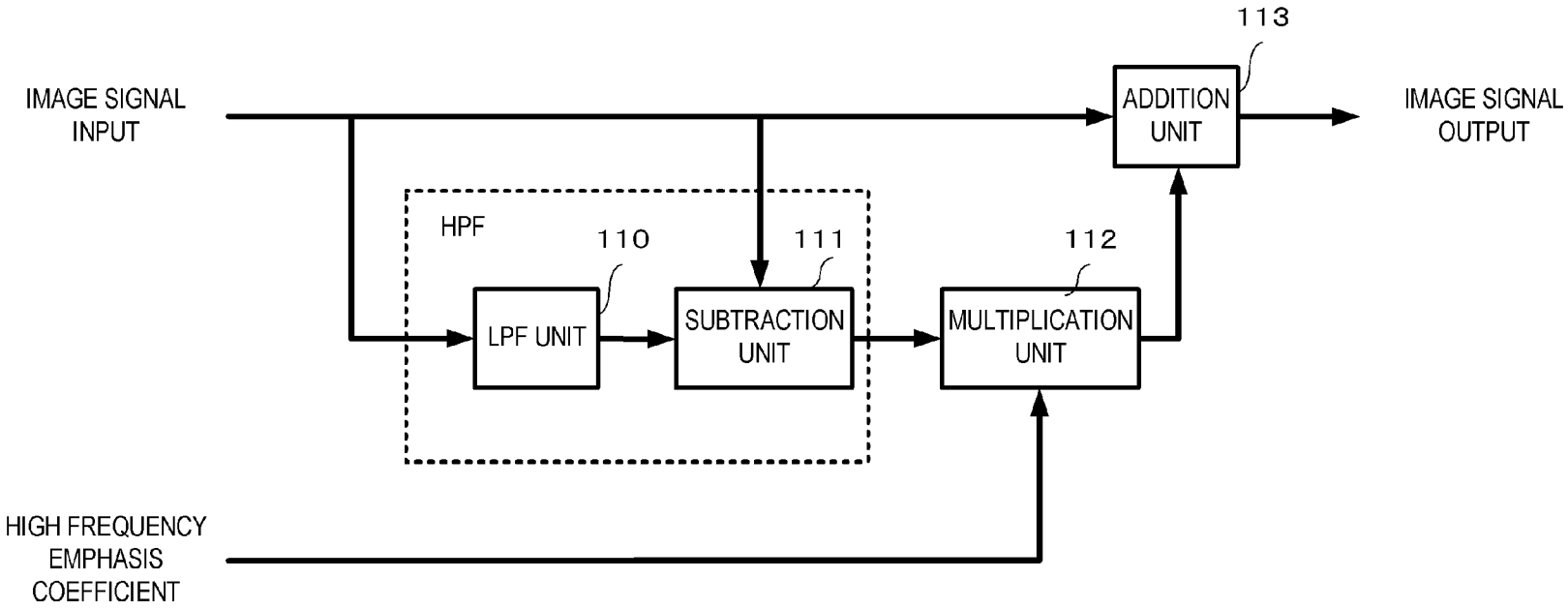
FIG. 2 is a view showing an example of a functional configuration of a filter unit according to first and second embodiments.

An example of the configuration of the filter unit 102 is shown in FIG. 2. The filter unit 102 includes an LPF (low-pass filter) unit 110, a subtraction unit 111, a multiplication unit 112, and an addition unit 113. The LPF unit 110 performs filtering processing on the inputted image signal (hereinafter referred to as an original image signal) to thereby generate and output a high-frequency component reduction image signal in which the spatial high-frequency component is reduced. The subtraction unit 111 subtracts the high-frequency component reduction image signal generated in the LPF unit 110 from the original image signal to thereby generate and output a high-frequency component signal. Thus, an HPF (high-pass filter) is composed of the LPF unit 110 and the subtraction unit 111, and the high-frequency component signal of the original image signal is extracted. The multiplication unit 112 multiplies the high-frequency component signal outputted from the subtraction unit 111 by the high frequency emphasis coefficient, and output the resultant signal. That is, the multiplication unit 112 plays a role of a sign inversion unit for inverting the sign of the high-frequency component signal in accordance with whether the original image signal is the image signal of the first sub-frame or the second sub-frame. The addition unit 113 adds the signal outputted from the multiplication unit 112 to the original image signal, and outputs the resultant signal.

Since 1 is given as the high frequency emphasis coefficient from the control unit 101 in the first sub-frame, a high frequency emphasis image signal obtained by adding the high-frequency component signal to the original image signal is outputted from the filter unit 102. Since −1 is given as the high frequency emphasis coefficient from the control unit 101 in the second sub-frame, a high frequency suppression image signal obtained by subtracting the high-frequency component signal from the original image signal is outputted from the filter unit 102.

The level compression unit (level adjustment unit) 103 compresses the level of the image signal outputted from the filter unit 102 to generate a level compression image signal, and outputs the level compression image signal to the liquid crystal panel unit 105. Note that the level of the image signal is synonymous with the value (gradation value) of the image signal and, for example, an 8-bit image signal takes the level in the range of 0 (minimum gradation, also referred to as a shadow) to 255 (maximum gradation, also referred to as a highlight). As seen from FIG. 2, in the high-frequency component signal extracted in the HPF, since the level of the image signal equal to that of the original image signal occurs on positive and negative sides, the high-frequency component signal can take the level in the range of −255 to 255. As a result, there is a possibility that the high frequency emphasis image signal obtained by adding the high-frequency component signal to the original image signal takes the level of 510 at the maximum, i.e., the level approximately twice that of the original image signal. To cope with that, the level compression unit 103 performs level compression processing on the image signal inputted from the filter unit 102 such that the level of an output image signal falls within the gradation range of the liquid crystal panel unit 105.

The level compression processing is processing for equally reducing levels of the image signals of all pixels (i.e., at a constant reduction ratio), and is different from conventional limit processing by a clip circuit or limiter circuit in that the same gradation of an image is maintained before and after the conversion. The level compression processing can be implemented by, e.g., processing for multiplying the image signal by a gain smaller than 1. Specifically, as described above, when there is a possibility that the high frequency emphasis image signal takes the level approximately twice that of the input image signal at the maximum, it is sufficient to perform the multiplication by using the gain of 0.5. The level compression unit 103 of the present embodiment multiplies the image signal by the gain of 0.5 to thereby compress the signal level to ½. Note that, for the pixel having a negative value as the level of the image signal, limit processing for limiting the value to 0 is performed as in conventional cases.

Thus, the processing for collectively converting the level of the image signal (pixel value) while maintaining the gradation of an image of the image signal is referred to as level adjustment processing. The level adjustment processing includes level expansion processing for collectively increasing the level of the image signal (see a third embodiment) in addition to the level compression processing for collectively reducing the level of the image signal.

The backlight control unit (light source control unit) 104 controls the light quantity (luminous intensity) of the backlight of the liquid crystal panel unit 105. In the present embodiment, the signal level is compressed to ½ in the level compression unit 103 and the transmittance of light of the liquid crystal device of the liquid crystal panel unit 105 is thereby reduced by half so that the backlight control unit 104 increases the light quantity of the backlight to a quantity twice a standard light quantity in order to compensate for a reduction in brightness. Note that the "standard light quantity" is a default light quantity used when the image signal not subjected to the level compression processing (i.e., the image signal having the same level as that of the input image signal) is outputted. That is, the standard light quantity is the light quantity of the light source adjusted so as to be able to obtain the target brightness when the transmittance of the liquid crystal is controlled and the image is displayed based on the signal level of the input image signal. For example, when the image display apparatus has a display mode in which the frame rate conversion or high frequency emphasis processing is not performed, the default light quantity set in the display mode is the standard light quantity.

The liquid crystal panel unit 105 is a display panel composed of the backlight as the light source and the liquid crystal device for controlling the transmittance of light of the backlight. The liquid crystal panel unit 105 controls the transmittance of the liquid crystal device based on the level compression image signal given from the level compression unit 103, and turns on the backlight based on a control value given from the backlight control unit 104. Subsequently, the liquid crystal panel unit 105 alternately displays a high frequency emphasis image of the first sub-frame and a high frequency suppression image of the second sub-frame at the frame rate twice that of the input image signal.

Figure 3:
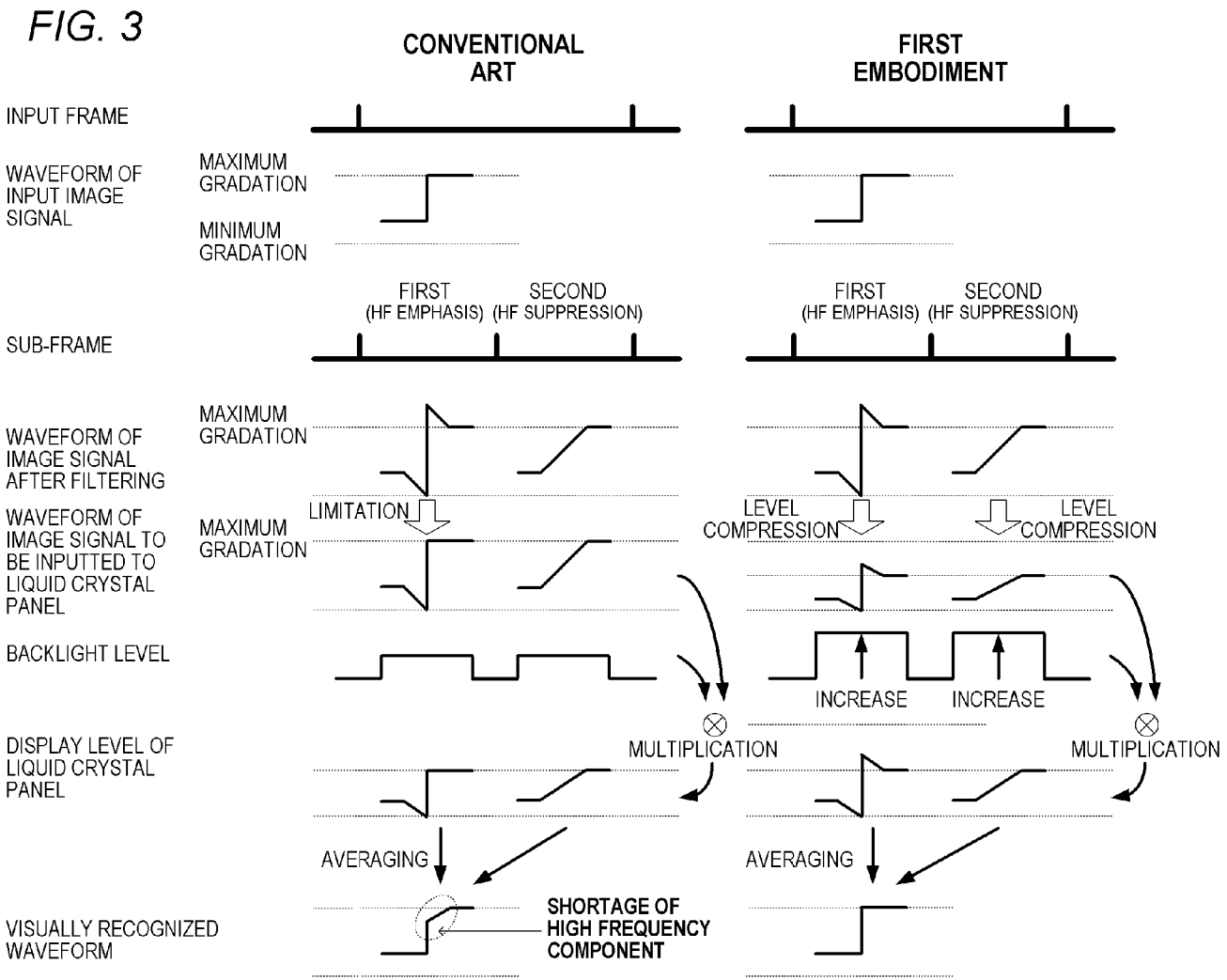
FIG. 3 is a view for explaining image processing according to the first embodiment.

FIG. 3 shows comparison between the image processing in the conventional art and the image processing according to the first embodiment.

In the conventional art, in the sub-frame of the high frequency emphasis image, when the image signal after filtering exceeds the maximum gradation, the signal level is limited. When the signal level is limited, the number of high-frequency components of the visually recognized image becomes insufficient, the effect of improving video resolution is reduced, and an interference feeling such as a motion blur or the like remains. By contrast, in the first embodiment, instead of limiting the signal level after filtering, the signal level is compressed by half, and the light quantity of the backlight is doubled to compensate for the display brightness, and hence the high-frequency component in the high frequency emphasis image is not lost.

Consequently, according to the present embodiment, in the processing method which controls the frequency component in the image signal on a per sub-frame basis to improve the video resolution, even when the signal level exceeds the maximum gradation by the high frequency emphasis processing, the effect of improving video resolution is not reduced.

Second Embodiment

A description is given hereinbelow of an image display apparatus and a control method therefor according to a second embodiment of the present invention with reference to the drawings. In the first embodiment, the signal level of each sub-frame has been compressed to ½ and the light quantity of the backlight has been doubled. However, in the sub-frame of the high frequency suppression image signal, since the signal level is not saturated inherently, there is no necessity to compress the signal level. Accordingly, in the sub-frame of the high frequency suppression image signal, when the signal level is compressed to ½ and the luminous intensity of the backlight is doubled to display the image, waste occurs in light emission efficiency of the liquid crystal panel. The present embodiment shows a configuration in which the same effect as that of the first embodiment is obtained and an improvement in light emission efficiency and a reduction in black level are implemented by controlling the light quantity of the backlight on a per sub-frame basis.

Figure 4:
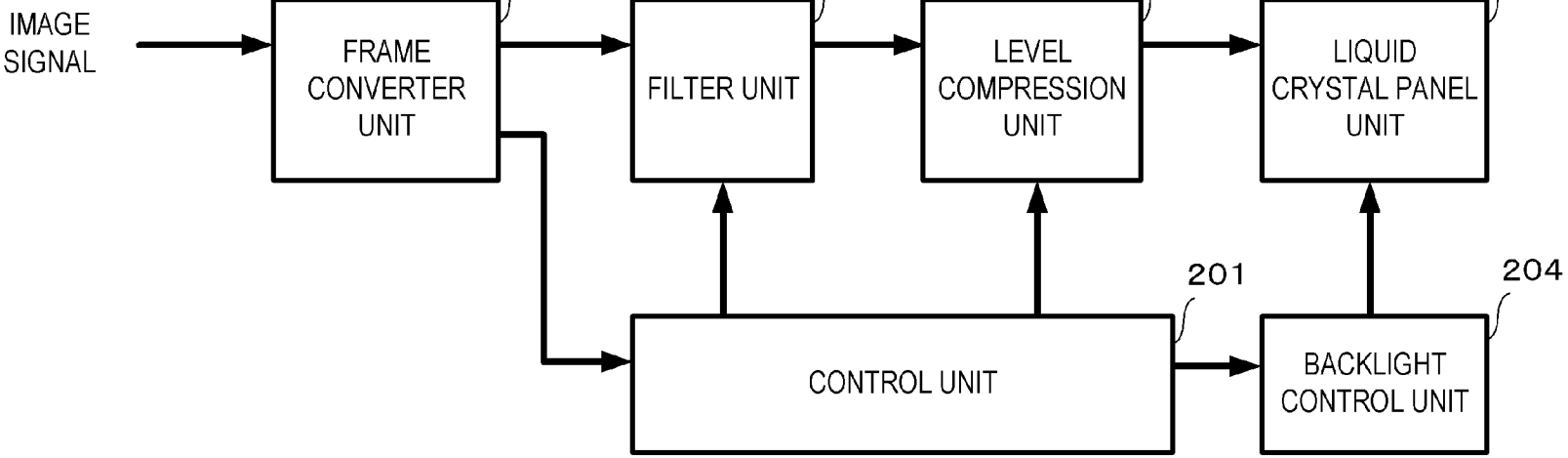
FIG. 4 is a view showing an example of a functional configuration of an image display apparatus according to the second embodiment.

FIG. 4 is a view showing an example of the functional configuration of the image display apparatus according to the second embodiment. The image display apparatus includes the frame converter unit 100, a control unit 201, the filter unit 102, a level compression unit 203, a backlight control unit 204, and the liquid crystal panel unit 105.

The functions of the frame converter unit 100, the filter unit 102, and the liquid crystal panel unit 105 are the same as those in the first embodiment.

The control unit 201 selects and outputs the high frequency emphasis coefficient, a level compression coefficient, and a backlight coefficient based on the sub-frame identification signal supplied from the frame converter unit 100. The high frequency emphasis coefficient is the same as that in the first embodiment, and is inputted to the filter unit 102. The level compression coefficient is a parameter for specifying a compression ratio of the signal level, and is inputted to the level compression unit 203. The backlight coefficient is a parameter for specifying an increase ratio of the light quantity of the backlight, and is inputted to the backlight control unit 204. Specific values of the individual coefficients are described later.

The level compression unit 203 multiplies the image signal by the level compression coefficient given from the control unit 201 to thereby compress the signal level of the image signal.

The backlight control unit 204 controls the light quantity (luminous intensity) of the backlight of the liquid crystal panel unit 105 in proportion to the backlight coefficient given from the control unit 201.

FIG. 5 shows an example of each coefficient outputted from the control unit 201 according to the second embodiment. In the example of FIG. 5, during the period of the first sub-frame, the high frequency emphasis image signal having the signal level compressed to ½ is displayed with the backlight having the light quantity twice the standard light quantity. On the other hand, during the period of the second sub-frame, the high frequency suppression image signal not subjected to the level compression (i.e., the compression ratio is 1/1) is displayed with the backlight having the light quantity as much as the standard light quantity (i.e., the standard light quantity).

Thus, in the second sub-frame in which the high frequency suppression image is displayed, the high frequency suppression image is displayed with the backlight as much as the standard light quantity without compressing the signal level, whereby it is possible to effectively utilize the light emission of the backlight. In addition, since the light quantity of the backlight in the second sub-frame is small, it becomes possible to reduce the brightness of the black level to a level lower than that in the first embodiment.

Figure 6:
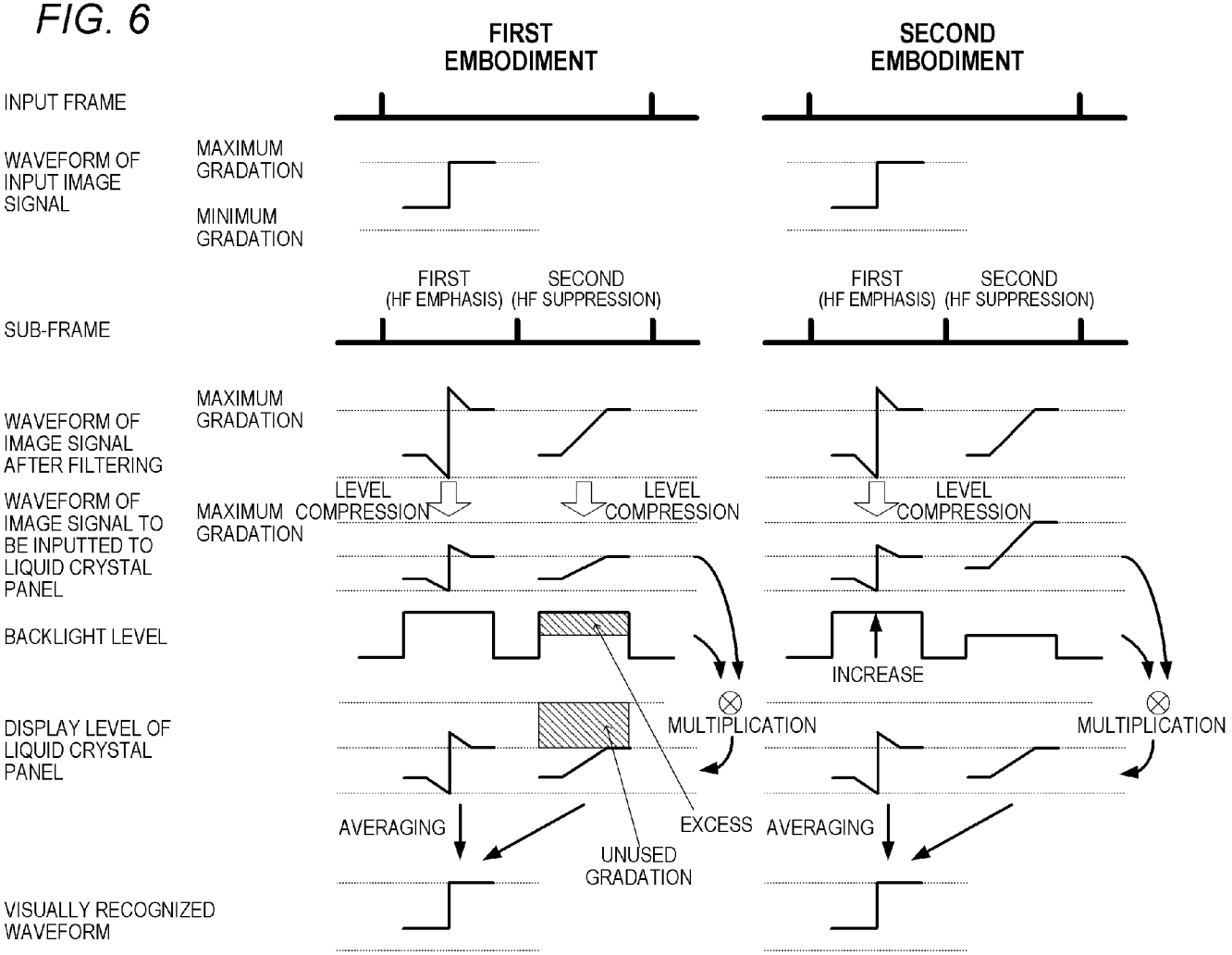
FIG. 6 is a view for explaining image processing according to the second embodiment.

FIG. 6 shows comparison between the image processing according to the first embodiment and the image processing according to the second embodiment. In the configuration of the first embodiment, since the signal level is compressed and the luminous intensity of the backlight is increased also in the second sub-frame of the high frequency suppression image, a part of the light emission of the backlight is wasted without being utilized. The hatched portions in FIG. 6 schematically show the wasted light emission. In contrast to this, in the configuration of the second embodiment, since the signal level is not compressed in the second sub-frame of the high frequency suppression image, it is not necessary to increase the light quantity of the backlight to a quantity larger than the standard light quantity. Therefore, it is possible to improve the light emission efficiency of the liquid crystal panel.

In addition, by controlling the high frequency emphasis coefficient, it is also possible to control the degree of the improvement in video resolution and the degree of the light emission efficiency. For example, on the assumption that $\alpha$ represents a coefficient in the range of 0 to 1, in the sub-frame in which the high frequency emphasis image is displayed, the high frequency emphasis coefficient may be represented by $\alpha$, the level compression coefficient may be represented by $1/(1+\alpha)$, and the backlight coefficient may be represented by $(1+\alpha)$. While in the sub-frame in which the high frequency suppression image is displayed, the high frequency emphasis coefficient may be represented by $-\alpha$. When the value of $\alpha$ is increased, the effect of improving video resolution can be enhanced. Conversely, when the value of $\alpha$ is reduced, the light emission efficiency can be enhanced.

Thus, according to the present embodiment, it is possible to implement the improvement in the light emission efficiency of the liquid crystal panel and the reduction in the brightness of the black level in addition to the effect of the first embodiment.

Third Embodiment

A description is given hereinbelow of an image display apparatus and a control method therefor according to a third embodiment of the present invention with reference to the drawings. The present embodiment shows a configuration in which, in the sub-frame in which the high frequency suppression image is displayed, by controlling the signal level and the backlight light quantity in accordance with a peak value of the high frequency suppression image signal, a further improvement in light emission efficiency and a further reduction in black level are implemented.

Figure 7:
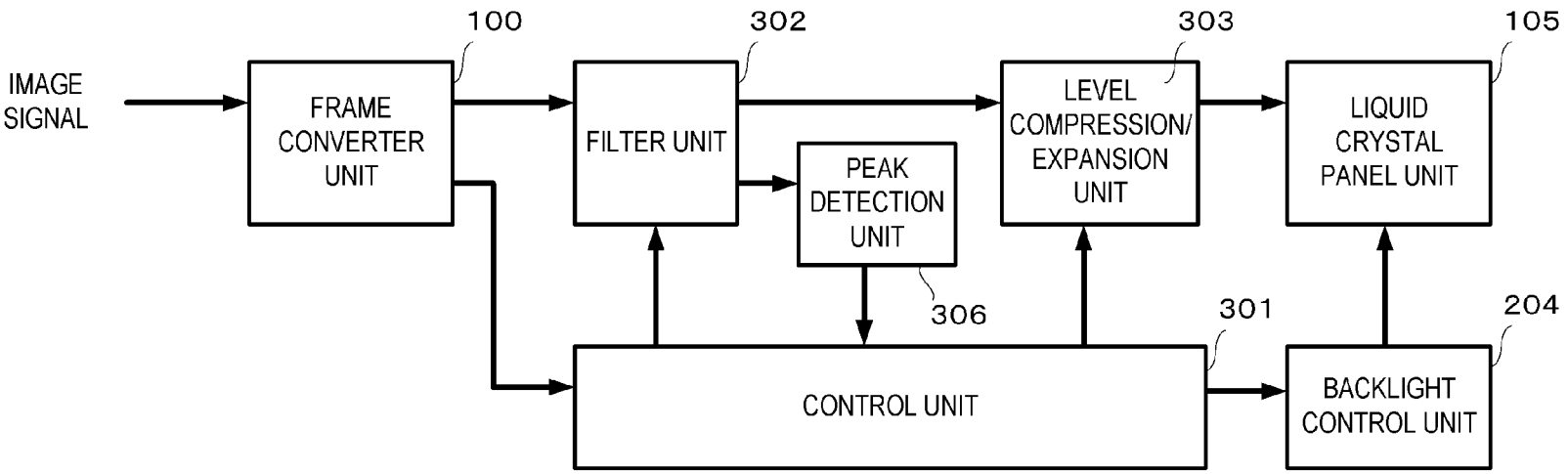
FIG. 7 is a view showing an example of a functional configuration of an image display apparatus according to a third embodiment.

FIG. 7 is a block diagram showing an example of the functional configuration of the image display apparatus according to the present embodiment. The image display apparatus includes the frame converter unit 100, a control unit 301, a filter unit 302, a level compression/expansion unit 303, the backlight control unit 204, the liquid crystal panel unit 105, and a peak detection unit 306. In the present embodiment, the level compression/expansion unit 303 corresponds to the level adjustment unit of the present invention.

The functions of the frame converter unit 100 and the liquid crystal panel unit 105 are the same as those in the first embodiment. The backlight control unit 204 is the same as that in the second embodiment.

The filter unit 302 outputs the image in which the spatial high-frequency component of an input image signal is emphasized or suppressed based on the high frequency emphasis coefficient, and outputs an image signal in complementary relation to the image signal.

Figure 8:
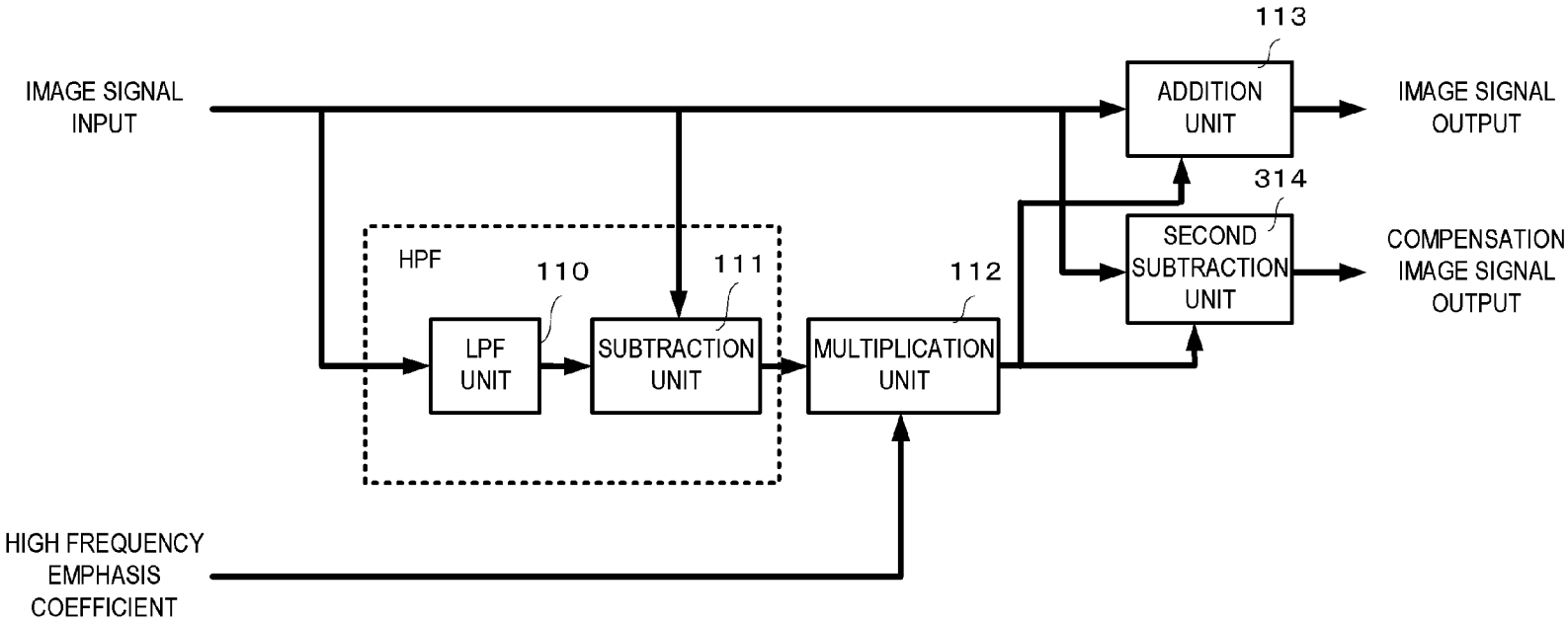
FIG. 8 is a view showing an example of a functional configuration of a filter unit according to the third embodiment.

FIG. 8 shows an example of the functional configuration of the filter unit 302 according to the third embodiment. The filter unit 302 includes the LPF unit 110, the subtraction unit 111, the multiplication unit 112, the addition unit 113, and a second subtraction unit 314. The functions of the LPF unit 110, the subtraction unit 111, the multiplication unit 112, and the addition unit 113 are the same as those in the first embodiment. The second subtraction unit 314 subtracts the high-frequency component outputted from the multiplication unit 112 from the input image signal, and outputs the resultant signal as a compensation image signal. When the high frequency emphasis coefficient is positive and the high frequency emphasis image signal is outputted from the filter unit 302, the high frequency suppression image signal is outputted as the compensation image signal. Conversely, when the high frequency emphasis coefficient is negative and the high frequency suppression image signal is outputted from the filter unit 302, the high frequency emphasis image signal is outputted as the compensation image signal. In the following description, the high frequency emphasis coefficient of the first sub-frame is assumed to be positive, the high frequency emphasis coefficient of the second sub-frame is assumed to be negative, and absolute values therefor are assumed to be the same. Under the assumption, the first sub-frame is a sub-frame in which the high frequency emphasis image is displayed, the second sub-frame is a sub-frame in which the high frequency suppression image is displayed, and the compensation image signal outputted in the first sub-frame is an image signal identical with the high frequency suppression image signal outputted in the second sub-frame.

The peak detection unit 306 detects a peak value during the period of one sub-frame of the compensation image signal (the maximum value among all pixels of one sub-frame in the compensation image signal) outputted from the filter unit 302, and gives the detected peak value to the control unit 301. When the image signal is an RGB signal, the peak value is a peak value among all of three colors of RGB.

The control unit 301 selects and outputs the high frequency emphasis coefficient, a level compression/expansion coefficient, and the backlight coefficient based on the sub-frame identification signal supplied from the frame converter unit 100. However, the level compression/expansion coefficient and the backlight coefficient of the second sub-frame are calculated from the peak value of the compensation image signal of the first sub-frame given from the peak detection unit 306. At this point, the control unit 301 determines the level compression/expansion coefficient in inverse proportion to the peak value such that the level compression/expansion coefficient is larger as the peak value is smaller. Preferably, when it is assumed that the maximum gradation value of the image signal is represented by Pmax, and the peak value is represented by P, the level compression/expansion coefficient G may be calculated by the following expression. According to the following expression, the coefficient G is determined such that a value P·G obtained by multiplying the peak value P by the level compression/expansion coefficient G becomes equal to the maximum value Pmax of the image signal which can be outputted to the liquid crystal panel unit 105.

$$G=P\max/P$$

Since the reciprocal of the level compression/expansion coefficient may be used as the backlight coefficient, the control unit 301 outputs 1/G as the backlight coefficient.

FIG. 9 shows an example of each coefficient outputted from the control unit 301 according to the third embodiment.

The basic operations of the level compression/expansion unit 303 are the same as those of the level compression unit 203, and the level compression/expansion unit 303 multiplies the image signal by the level compression/expansion coefficient given from the control unit 301 to thereby convert the signal level of the image signal. When the level compression/expansion coefficient is smaller than 1, the level compression processing for equally reducing the values of all pixels is performed and, when the level compression/expansion coefficient is larger than 1, level expansion processing for equally increasing the values of all pixels is performed.

Figure 10:
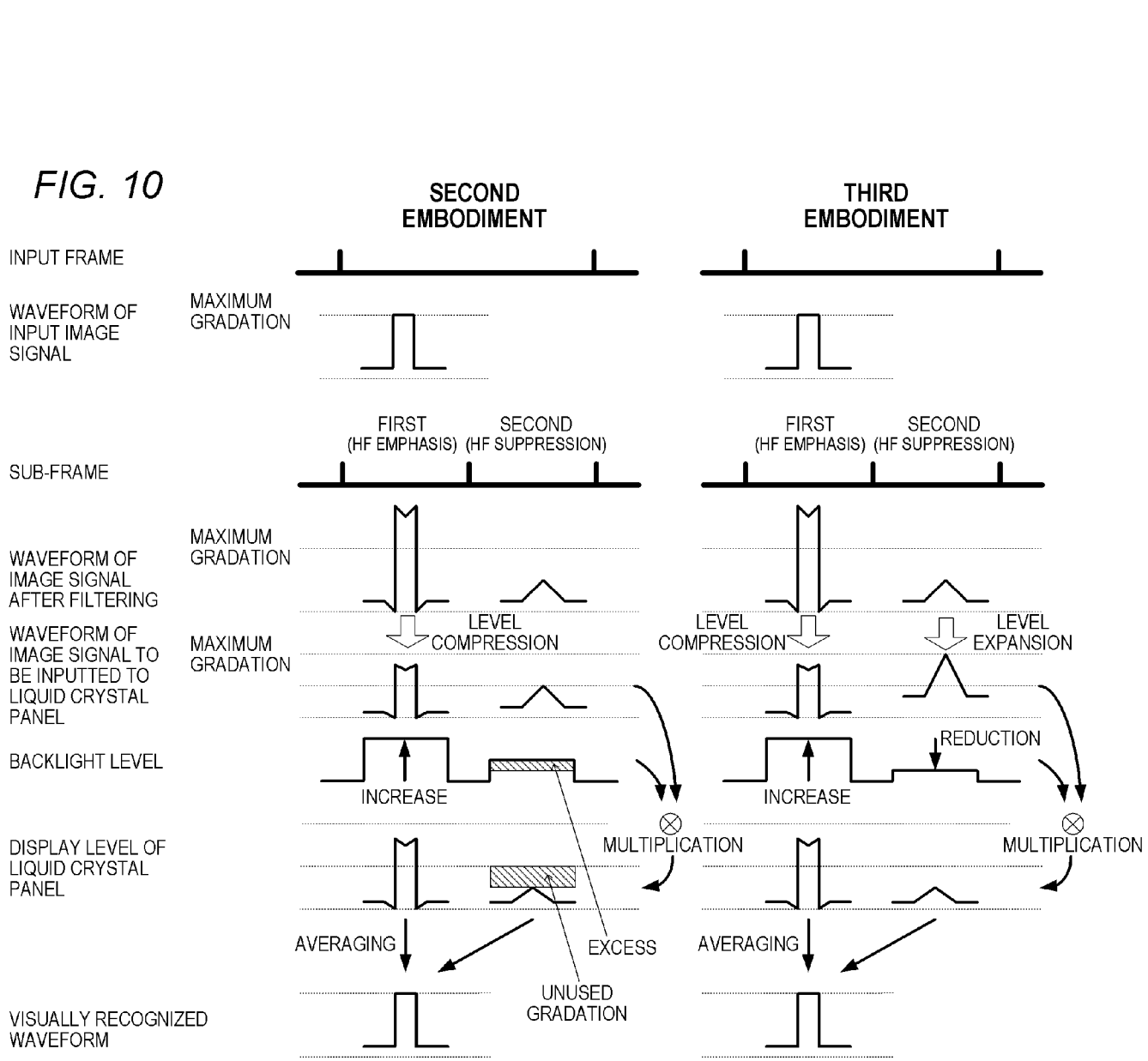
FIG. 10 is a view for explaining image processing according to the third embodiment.

FIG. 10 shows comparison between the image processing according to the second embodiment and the image processing according to the third embodiment. In the second embodiment, although the backlight emits light with the standard light quantity, when the peak value of the high frequency suppression image signal is smaller than the maximum gradation, there are cases where a part of the light emission of the backlight is not used and wasted. In the third embodiment, the control in which the level expansion of the image signal and the reduction of the light quantity of the backlight are performed in accordance with the peak value of the high frequency suppression image signal allows a further improvement in the light emission efficiency of the liquid crystal panel and a further reduction in the brightness of the black level in the sub-frame in which the high frequency suppression image is displayed. In addition, in the present embodiment, by determining the level compression/expansion coefficient by the above-described expression, it is possible to maximally increase the signal level of the high frequency suppression image signal, and hence it is possible to suppress the backlight light quantity during the period of the second sub-frame to the minimum quantity.

Further, in the configuration of the present embodiment, by utilizing the compensation image signal of the high frequency emphasis image signal of the first sub-frame for the detection of the peak value, it is possible to detect the peak value of the high frequency suppression image to be outputted in the second sub-frame concurrently with the filtering processing of the first sub-frame. As a result, it is not necessary to delay the image display for the detection of the peak value, and complete the processing from the input of the image signal to the image display within a short delay time period.

Note that, in order to prevent frequent change of the luminous intensity of the backlight in the sub-frame in which the high frequency suppression image is displayed, temporal stabilization processing may be performed on the level compression/expansion coefficient. For example, when it is assumed that the level compression/expansion coefficient of the previous frame is represented by G0 and a coefficient of a time constant is represented by β, the level compression/expansion coefficient G may be calculated by using the following expression:

$$G=P\max/P \text{ when } G0\geq P\max/P \text{ is satisfied}$$

$$G=G0+\beta(P\max/P-G0) \text{ when } G0<P\max/P \text{ is satisfied}$$

wherein β is a positive value not more than 1.

In the foregoing, the description has been given of the case where, by utilizing the compensation image signal outputted when the high frequency emphasis image signal is outputted from the filter unit 302, the peak value of the compensation image signal of the first sub-frame is detected and the level compression/expansion coefficient G of the second sub-frame is determined. In a case where, after the second sub-frame (the high frequency suppression image) of an input image signal, the first sub-frame (the high frequency emphasis image) of the input image signal is outputted to the liquid crystal panel unit 105, the level compression/expansion coefficient G of the first sub-frame may be determined by detecting the peak value of the compensation image signal of the second sub-frame.

Thus, according to the present embodiment, it is possible to implement a further improvement in the light emission efficiency of the liquid crystal panel and a further reduction in the brightness of the black level in addition to the effects of the first and second embodiments.

Fourth Embodiment

A description is given hereinbelow of an image display apparatus and a control method therefor according to a fourth embodiment of the present invention with reference to the drawings. The present embodiment shows a configuration in a projection type display apparatus in which light of a light source is projected through a liquid crystal device and an image is thereby displayed such as a liquid crystal projector or the like.

Figure 11:
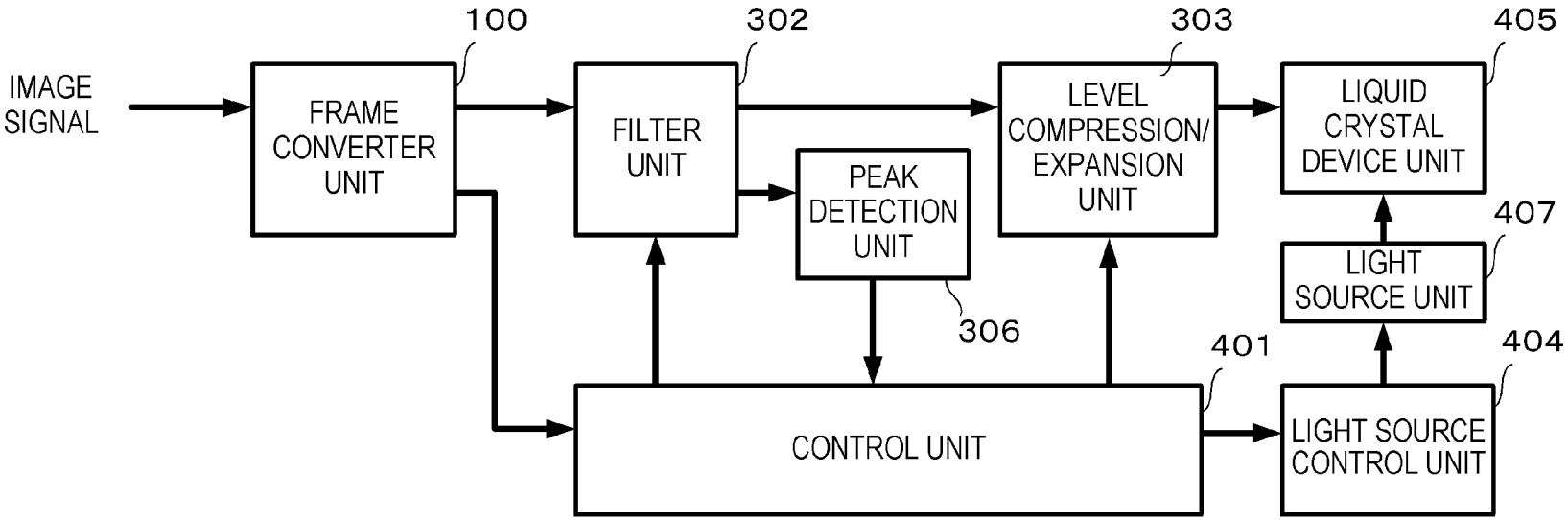
FIG. 11 is a view showing an example of a functional configuration of an image display apparatus according to a fourth embodiment.

FIG. 11 is a block diagram showing the functional configuration of the image display apparatus according to the present embodiment. The image display apparatus includes the frame converter unit 100, a control unit 401, the filter unit 302, the level compression/expansion unit 303, a light source control unit 404, a liquid crystal device unit 405, the peak detection unit 306, and a light source unit 407.

The operations of the frame converter unit 100, the filter unit 302, the level compression/expansion unit 303, and the peak detection unit 306 are the same as those in the third embodiment.

Although the basic operations of the control unit 401 are the same as those of the control unit 301 in the third embodiment, in the control unit 401, a light source coefficient is outputted instead of the backlight coefficient outputted in the control unit 301. The control unit 401 selects and outputs the high frequency emphasis coefficient, the level compression/expansion coefficient, and the light source coefficient based on the sub-frame identification signal given from the frame converter unit 100. The reciprocal of the level compression/expansion coefficient may be used as the light source coefficient.

The light source control unit 404 controls the light quantity of the light source of the light source unit 407 such that the luminous intensity of a projected image changes in proportion to the light source coefficient given from the control unit 401.

The light source unit 407 turns on the light source with the light quantity based on the control by the light source control unit 404 to emit light to the liquid crystal device of the liquid crystal device unit 405.

The liquid crystal device unit 405 changes the transmittance of light of the liquid crystal device based on the image signal subjected to the level compression or level expansion which is outputted from the level compression/expansion unit 303.

Thus, the present invention can also be applied to the projection type liquid crystal display apparatus. Note that, although the example in which the image processing of the third embodiment is applied to the projection type liquid crystal display apparatus has been described in the present embodiment, the image processing of the first or second embodiment can also be applied to the projection type liquid crystal display apparatus.

Fifth Embodiment

A description is given hereinbelow of an image display apparatus and a control method therefor according to a fifth embodiment of the present invention with reference to the drawings. The present embodiment shows a configuration in a display which causes electrons of a quantity in correspondence to the pixel value of the image signal to be emitted from cold cathode electron emission elements arranged in a matrix, accelerates the emitted electrons using an acceleration voltage, and causes the electrons to collide with a fluorescent material to emit light.

Figure 12:
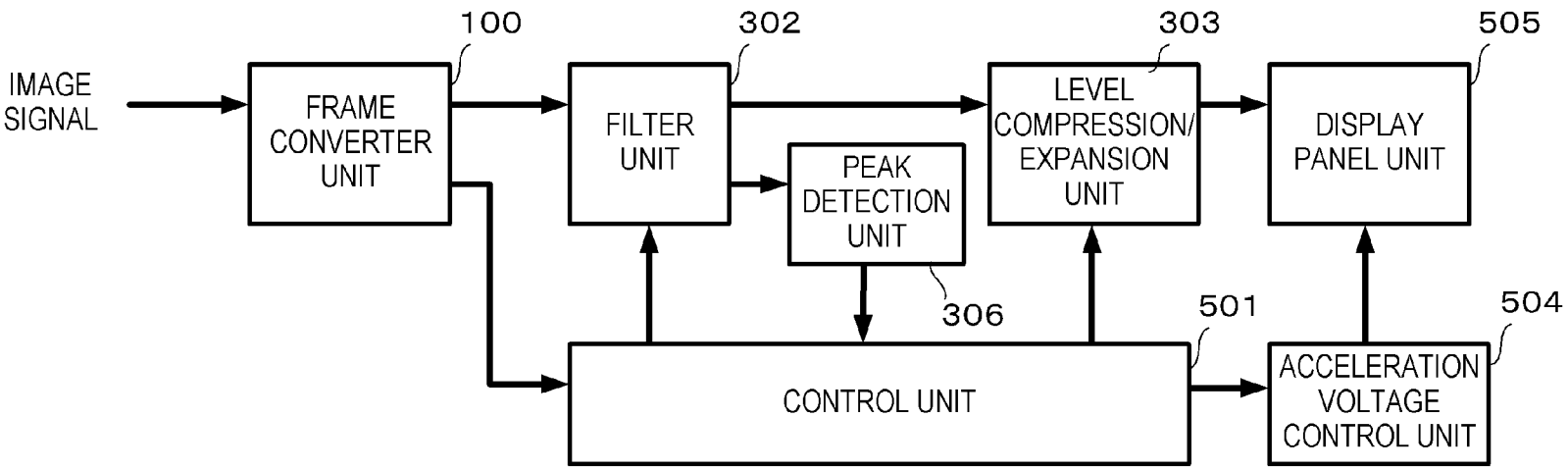
FIG. 12 is a view showing an example of a functional configuration of an image display apparatus according to a fifth embodiment.

FIG. 12 is a block diagram showing the functional configuration of the image display apparatus according to the present embodiment. The image display apparatus includes the frame converter unit 100, a control unit 501, the filter unit 302, the level compression/expansion unit 303, an acceleration voltage control unit 504, a display panel unit 505, and the peak detection unit 306.

The operations of the frame converter unit 100, the filter unit 302, the level compression/expansion unit 303, and the peak detection unit 306 are the same as those in the third embodiment.

Although the basic operations of the control unit 501 are the same as those of the control unit 301 in the third embodiment, in the control unit 501, an acceleration voltage coefficient is outputted instead of the backlight coefficient outputted in the control unit 301. The control unit 501 selects and outputs the high frequency emphasis coefficient, the level compression/expansion coefficient, and the acceleration voltage coefficient based on the sub-frame identification signal given from the frame converter unit 100. The reciprocal of the level compression/expansion coefficient may be used as the acceleration voltage coefficient.

The acceleration voltage control unit 504 controls a voltage for accelerating electrons emitted from cold cathode elements of the display panel unit 505 to thereby control the luminous intensity of the display panel in proportion to the acceleration voltage coefficient.

Thus, according to the present embodiment, even in the self-emitting display which accelerates electrons emitted from the cold cathode elements arranged in the matrix using the acceleration voltage and causes the electrons to collide with the fluorescent material to emit light, the effects similar to those of the first to third embodiments are obtained.

Note that each of the first to fifth embodiments described above is a specific example of the present invention, and the scope of the present invention is not limited to the configuration of each of the embodiments.

For example, the present invention can also be applied to a configuration in which the frame rate is increased three times or more. In this case, the number of sub-frames becomes three or more. Among the plurality of sub-frames, by performing the compression of the signal level and the increase of the light quantity of the backlight on at least one sub-frame subjected to the high frequency emphasis processing, it is possible to obtain the effects similar to those of the above embodiments. In addition, in the above embodiments, a temporally preceding sub-frame is set as the first sub-frame subjected to the high frequency emphasis processing, and a sub-frame subsequent to the sub-frame is set as the second sub-frame subjected to the high frequency suppression processing. However, the temporally preceding sub-frame may also be set as the second sub-frame, or another sub-frame may be present between the first and second sub-frames. In addition, when three or more sub-frames are present, the high frequency emphasis processing (or the high frequency suppression processing) may also be performed on two or more sub-frames.

Further, in the above embodiments, various coefficients are set such that the reciprocal of the ratio (the compression ratio or expansion ratio) of the signal level corresponds to the ratio (the increase ratio or reduction ratio) of the light quantity of the backlight, and the display brightness of the input image signal is thereby maintained. However, if it is not necessary to maintain the display brightness, the ratio of the light quantity may not be the reciprocal of the ratio of the signal level. For example, in the first embodiment, even when the signal level is compressed to ½, the light quantity of the backlight may be increased to a quantity 1.5 times or 3 times the standard light quantity, and benefits of the present invention can be maintained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-260079, filed on Nov. 22, 2010 and Japanese Patent Application No. 2011-171638, filed on Aug. 5, 2011, which are hereby incorporated by reference herein in their entirety.

What is claimed is:

1. An image display apparatus comprising:

a light source;

a display panel unit configured to control a transmittance of light from the light source based on an image data;

an image processing unit configured to divide each frame of an input image data into a plurality of sub-frames, and to output the image data of the plurality of sub-frames to the display panel unit at a frame rate higher than that of the input image data; and a light source control unit configured to control a light quantity of the light source, the image processing unit including:

a control unit configured to output a filter coefficient for each sub-frame;

a filter unit configured to perform high frequency emphasis processing for emphasizing a spatial high-frequency component with the filter coefficient given from the control unit on the image data of a first sub-frame among the plurality of sub-frames so that the filter coefficient is larger, the spatial high-frequency component of the image data of the first sub-frame is more emphasized, and to perform high frequency suppression processing for suppressing a spatial high-frequency component on the image data of a second sub-frame different from the first sub-frame; and an adjustment unit configured to perform level adjustment processing on the high-frequency-emphasized image data of the first sub-frame using a first level compression/expansion coefficient which decreases as the filter coefficient given from the control unit increases, and to perform level adjustment processing on the high-frequency-suppressed image data of the second sub-frame using a second level compression/expansion coefficient different from the first level compression/expansion coefficient, and the light source control unit controls the light quantity of the light source during a period of a sub-frame in which the image data subjected to the level adjustment processing is outputted, in accordance with the level adjustment performed on the sub-frame.

2. The image display apparatus according to claim 1, wherein the adjustment unit performs the level adjustment processing for equally reducing a value of each pixel on the image data of the first sub-frame, and does not perform the level adjustment processing on the image data of the second sub-frame, and the light source control unit performs control in which the light quantity of the light source during the period of the first sub-frame is increased as compared with a standard light quantity in a case where the image data not subjected to the level adjustment processing is outputted, and the light quantity of the light source during the period of the second sub-frame is made equal to the standard light quantity.

3. The image display apparatus according to claim 1, wherein the control unit determines the filter coefficient such that a value obtained by multiplying a peak value of the high-frequency-emphasized image by the first level compression/expansion coefficient becomes equal to a maximum value which can be outputted to the display panel.

4. The image display apparatus according to claim 1, wherein the control unit outputs the filter coefficient that is positive during the period of the first sub-frame, and outputs the filter coefficient that is negative during the period of the second sub-frame.

5. The image display apparatus according to claim 1, wherein the control unit outputs the filter coefficient of 1 during the period of the first sub-frame, and outputs the filter coefficient of −1 during the period of the second sub-frame.

6. The image display apparatus according to claim 1, wherein the control unit outputs the filter coefficient for each sub-frame based on a sub-frame identification signal identifying whether each sub-frame is the first sub-frame or the second sub-frame.

7. The image display apparatus according to claim 1, wherein the adjustment unit performs the level adjustment processing for equally reducing a value of each pixel on the image data of the first sub-frame, and performs the level adjustment processing for equally increasing the value of each pixel on the image data of the second sub-frame, and the light source control unit performs control in which the light quantity of the light source during the period of the first sub-frame is increased as compared with a standard light quantity in a case where the image data not subjected to the level adjustment processing is outputted, and the light quantity of the light source during the period of the second sub-frame is reduced as compared with the standard light quantity.

8. The image display apparatus according to claim 7, wherein, in the adjustment unit, the level adjustment processing for equally reducing the value of each pixel is processing in which the value of each pixel of the image data is multiplied by the first level compression/expansion coefficient smaller than 1, and the level adjustment processing for equally increasing the value of each pixel is processing in which the value of each pixel of the image data is multiplied by the second level compression/expansion coefficient larger than 1.

9. The image display apparatus according to claim 8, wherein the filter unit generates the image data by performing the high frequency suppression processing for suppressing the spatial high-frequency component on the image data of the second sub-frame among the plurality of sub-frames, and a compensation image data by emphasizing the spatial high-frequency component of the image data of the second sub-frame, and the image processing unit includes a peak detection unit which detects a peak value of the pixel values in the compensation image data generated by the filter unit, wherein the control unit determines the first level compression/expansion coefficient in accordance with the peak value detected by the peak detection unit.

10. The image display apparatus according to claim 8, wherein the filter unit generates the image data by performing the high frequency emphasis processing for emphasizing the spatial high-frequency component on the image data of the first sub-frame among the plurality of sub-frames, and a compensation image data by suppressing the spatial high-frequency component of the image data of the first sub-frame, and the image processing unit includes a peak detection unit which detects a peak value of the pixel values in the compensation image data generated by the filter unit, wherein the control unit determines the second level compression/expansion coefficient in accordance with the peak value detected by the peak detection unit.

11. The image display apparatus according to claim 10, wherein the control unit determines the second level compression/expansion coefficient such that a value obtained by multiplying the peak value detected by the detection unit by the second level compression/expansion coefficient becomes equal to a maximum value of the image data which can be outputted to the display panel unit.

12. The image display apparatus according to claim 10, wherein the filter unit includes:

a high-pass filter which extracts a high-frequency component data from an original image data inputted to the filter unit;

a sign inversion unit which inverts a sign of the high-frequency component data extracted by the high-pass filter such that a positive sign is set when the original image data is the image data of the first sub-frame, and a negative sign is set when the original image data is the image data of the second sub-frame;

an addition unit which adds, to the original image data, the high-frequency component data outputted from the sign inversion unit; and a subtraction unit which subtracts, from the original image data, the high-frequency component data outputted from the sign inversion unit, and the output from the addition unit is connected to the adjustment unit, and the output from the subtraction unit is connected to the peak detection unit.

13. A control method for an image display apparatus which includes a light source and a display panel unit configured to control a transmittance of light from the light source based on an image data, comprising:

dividing each frame of an input image data into a plurality of sub-frames;

determining a filter coefficient for each sub-frame;

performing high frequency emphasis processing for emphasizing a spatial high-frequency component with the filter coefficient on the image data of a first sub-frame among the plurality of sub-frames so that the filter coefficient is larger, the spatial high-frequency component of the image data of the first sub-frame is more emphasized, and performing high frequency suppression processing for suppressing a spatial high-frequency component on the image data of a second sub-frame different from the first sub-frame;

performing level adjustment processing on the high-frequency-emphasized image data of the first sub-frame using a first level compression/expansion coefficient which decreases as the filter coefficient increases, and performing level adjustment processing on the high-frequency-suppressed image data of the second sub-frame using a second level compression/expansion coefficient different from the first level adjustment coefficient; and outputting the image data of the plurality of sub-frames to the display panel unit at a frame rate higher than that of the input image data, wherein a light quantity of the light source during a period of a sub-frame in which the image data subjected to the level adjustment processing is outputted is controlled in accordance with the level adjustment performed on the sub-frame.

14. The control method according to claim 13, wherein the level adjustment processing for equally reducing a value of each pixel on the image data of the first sub-frame is performed, and the level adjustment processing on the image data of the second sub-frame is not performed, and performing to control in which the light quantity of the light source during the period of the first sub-frame is increased as compared with a standard light quantity in a case where the image data not subjected to the level adjustment processing is outputted, and the light quantity of the light source during the period of the second sub-frame is made equal to the standard light quantity.

15. The control method according to claim 13, wherein the filter coefficient is determined such that a value obtained by multiplying a peak value of the high-frequency-emphasized image by the first level compression/expansion coefficient becomes equal to a maximum value which can be outputted to the display panel.

16. The control method according to claim 13, wherein the level adjustment processing for equally reducing a value of each pixel on the image data of the first sub-frame is performed, and the level adjustment processing for equally increasing the value of each pixel on the image data of the second sub-frame is performed, and performing to control in which the light quantity of the light source during the period of the first sub-frame is increased as compared with a standard light quantity in a case where the image data not subjected to the level adjustment processing is outputted, and the light quantity of the light source during the period of the second sub-frame is reduced as compared with the standard light quantity.

17. The control method according to claim 13, wherein the level adjustment processing for equally reducing the value of each pixel is processing in which the value of each pixel of the image data is multiplied by a the first level compression/expansion coefficient smaller than 1, and the level adjustment processing for equally increasing the value of each pixel is processing in which the value of each pixel of the image data is multiplied by a the second adjustment coefficient larger than 1.

18. The control method according to claim 17, comprising:

generating the image data by performing the high frequency suppression processing for suppressing the spatial high-frequency component on the image data of the second sub-frame among the plurality of sub-frames, and a compensation image data by emphasizing the spatial high-frequency component of the image data of the second sub-frame;

detecting a peak value of the pixel values in the compensation image data; and determining the first level compression/expansion coefficient in accordance with the peak value detected.

19. The control method according to claim 17, comprising:

generating the image data by performing the high frequency emphasis processing for emphasizing the spatial high-frequency component on the image data of the first sub-frame among the plurality of sub-frames, and a compensation image data by suppressing the spatial high-frequency component of the image data of the first sub-frame;

detecting a peak value of the pixel values in the compensation image data; and determining the second level compression/expansion coefficient in accordance with the peak value detected.

20. The control method according to claim 19, wherein the second level compression/expansion coefficient is determined such that a value obtained by multiplying the peak value by the second level compression/expansion coefficient becomes equal to a maximum value of the image data which can be outputted to the display panel unit.

21. The control method according to claim 19, comprising:

extracting, by a high-pass filter, a high-frequency component data from an original image data inputted;

inverting, by a sign inversion unit, a sign of the high-frequency component data extracted by the high-pass filter such that a positive sign is set when the original image data is the image data of the first sub-frame, and a negative sign is set when the original image data is the image data of the second sub-frame;

adding, by an addition unit, to the original image data, the high-frequency component data outputted from the sign inversion unit; and subtracting, by a subtraction unit, from the original image data, the high-frequency component data outputted from the sign inversion unit, wherein the output from the addition unit is used for the level adjustment, and the output from the subtraction unit is used for the peak detection.

22. An image display apparatus comprising:

a self-emitting display panel unit configured to cause an electron to be emitted from cold cathode elements arranged in a matrix based on an image data, and to accelerate the emitted electron using an acceleration voltage, causes the emitted electron to collide with a fluorescent material to emit light;

an image processing unit configured to divide each frame of an input image data into a plurality of sub-frames, and to output the image data of the plurality of sub-frames to the display panel unit at a frame rate higher than that of the input image data; and an acceleration voltage control unit configured to control the acceleration voltage, the image processing unit including:

a control unit configured to output a filter coefficient for each sub-frame;

a filter unit configured to perform high frequency emphasis processing for emphasizing a spatial high-frequency component with the filter coefficient given from the control unit on the image data of a first sub-frame among the plurality of sub-frames so that the filter coefficient is larger, the spatial high-frequency component of the image data of the first sub-frame is more emphasized, and to perform high frequency suppression processing for suppressing a spatial high-frequency component on the image data of a second sub-frame different from the first sub-frame; and an adjustment unit configured to perform level adjustment processing on the high-frequency-emphasized image data of the first sub-frame using a first level compression/expansion coefficient which decreases as the filter coefficient given from the control unit increases, and to perform level adjustment processing on the high-frequency-suppressed image data of the second sub-frame using a second level compression/expansion coefficient different from the first level compression/expansion coefficient, and the acceleration voltage control unit controls the acceleration voltage during a period of a sub-frame in which the image data subjected to the level adjustment processing is outputted, in accordance with the level adjustment performed on the sub-frame.

23. An image display apparatus comprising:

a light source;

a display panel unit configured to control a transmittance of light from the light source based on an image data;

an image processing unit configured to divide each frame of an input image data into a plurality of sub-frames, and to output the image data of the plurality of sub-frames to the display panel unit at a frame rate higher than that of the input image data; and a light source control unit configured to control a light quantity of the light source, the image processing unit including:

a control unit configured to output a filter coefficient for each sub-frame;

a filter unit configured to perform high frequency emphasis processing for emphasizing a spatial high-frequency component with the filter coefficient given from the control unit on the image data of a first sub-frame among the plurality of sub-frames so that the filter coefficient is larger, the spatial high-frequency component of the image data of the first sub-frame is more emphasized; and an adjustment unit configured to perform level compression processing for equally reducing a value of each pixel at least on the high-frequency-emphasized image data of the first sub-frame using a first level compression/expansion coefficient which decreases as the filter coefficient given from the control unit increases, and the light source control unit increases the light quantity of the light source during a period of a sub-frame in which the image data subjected to the level compression processing is outputted as compared with a standard light quantity in a case where the image data not subjected to the level compression processing is outputted.

* * * * *